United States Patent [19]

La Barge

[11] Patent Number: 4,932,555

[45] Date of Patent: Jun. 12, 1990

[54] RESEALABLE CAP HINGE STRUCTURE

[75] Inventor: Robert L. La Barge, Ben Avon Borough, Pa.

[73] Assignee: Aluminum Company of America, Pittsburgh, Pa.

[21] Appl. No.: 338,095

[22] Filed: Apr. 14, 1989

[51] Int. Cl.[5] ..... B65D 55/16

[52] U.S. Cl. ..... 220/375; 220/254; 220/334; 220/336; 220/339; 215/306

[58] Field of Search ..... 220/254, 259, 334–344, 220/375; 215/235–245, 306

[56] References Cited

U.S. PATENT DOCUMENTS

| | | | |
|---|---|---|---|
| 2,753,051 | 7/1956 | Tupper | 220/259 X |
| 3,199,707 | 8/1965 | Folkman | 215/306 |
| 3,807,597 | 4/1974 | Wells et al. . | |
| 3,902,626 | 9/1975 | Jordan et al. | 220/268 |
| 3,912,114 | 10/1975 | Morran et al. | 220/268 |
| 3,929,251 | 12/1975 | Urmston | 220/268 |
| 3,938,455 | 2/1976 | Urmston . | |
| 3,946,683 | 3/1976 | Jordan . | |
| 3,977,341 | 8/1976 | Jordan et al. . | |
| 3,997,076 | 12/1976 | Jordan | 220/268 |
| 4,024,981 | 5/1977 | Brown | 220/269 |
| 4,039,101 | 8/1977 | Wells | 220/269 |
| 4,148,410 | 4/1979 | Brown | 220/269 |
| 4,580,692 | 4/1986 | La Barge et al. | 220/240 |
| 4,615,462 | 10/1986 | Sacherer et al. | 220/339 |
| 4,641,932 | 2/1987 | Harms | 215/306 X |
| 4,648,528 | 3/1987 | La Barge et al. | 220/240 |
| 4,673,099 | 6/1987 | Wells | 220/269 |
| 4,678,096 | 7/1987 | La Barge et al. | 220/273 |
| 4,685,849 | 8/1987 | La Barge et al. | 413/22 |
| 4,699,290 | 10/1987 | Adams | 220/258 |
| 4,706,841 | 11/1987 | Grajek | 220/375 |
| 4,776,486 | 10/1988 | Mizusawa | 220/375 |
| 4,783,985 | 11/1988 | La Barge et al. | 72/379 |
| 4,793,510 | 12/1988 | Arfert et al. | 220/306 |

*Primary Examiner*—Stephen Marcus
*Assistant Examiner*—Nova Stucker
*Attorney, Agent, or Firm*—David W. Brownlee; Robert E. Isner

[57] ABSTRACT

This invention relates to an improved can end construction for carbonated beverage cans having a score line defined opening panel therein for beverage dispensing and, more particularly, to an improved construction for a resealing cap assembly for such type can ends.

13 Claims, 3 Drawing Sheets

RESEALABLE CAP HINGE STRUCTURE

BACKGROUND OF THE INVENTION

Recent years have witnessed ever increasing quantities of carbonated beverages, such as beer and carbonated soft drinks, being packaged in amounts up to 12 ounces in metal cans and particularly in metal cans with ends that include a score line defined opening panel therein to provide implement free access to the contents. Such opening panel containing can ends are generally called "easy open ends" and include variant basic constructions of a first type wherein the score line completely circumscribes the panel to render the panel completely separable from the can end and of a second type wherein the score line only partially circumscribes the panel to render the latter only partially severable from the can end and to thus remain in attached relation within the can end after the pouring opening has been formed. As mentioned above, such opening panels are conventionally perimetrically delineated by score lines of decreased metal thickness.

In order to extend the use of such easy open can end constructions to larger volume containers, the art has suggested the utilization of a cap assembly to close and reseal the opening defined by such score line defined panel. Among the objects of such cap utilization are a re-closure of the container to prevent loss of liquid content and a resealing of the container to limit further losses of the dissociable gases, i.e., the "carbonation", of the remaining liquid contents. U.S. Pat. No. 4,580,692 discloses one construction for such a resealable closure cap assembly in association with a selectively contoured can end construction to cooperatively accommodate such resealable closure and to retain the advantages characteristic of the "easy open end" construction.

The provision of commercially acceptable resealable easy open can end constructions for larger capacity beverage containers requires, in addition to the functional feature of present easy open can ends, sealable retention of the can contents, the securement of the sealing cap assembly to the can end, the accommodation by the resealed cap of the inherent pressure buildup therein and the minimization of hazard to the user in the event of destructive pressure release. Also required is a can end configuration to accommodate the disposition of the resealing cap thereon without appreciable diminution of the convenience and cost effective nature of the basic easy open end constructions during manufacture, filling, shipping, selling, and consumer usage. As such, the provision of a commercially acceptable resealable easy open end construction requires accommodation of problems not heretofore met in the basic easy open end constructions conventionally employed in the smaller capacity beverage can.

Experience to date with the resealable cap and can end construction disclosed in U.S. Pat. Nos. 4,580,692 and 4,648,528, the disclosure contents of which are herein generally incorporated by reference, has indicated a need to assure retention of the resealing cap assembly in secured relation to the can end under conditions where excessive pressure buildup within the can results in a separation of the resealable cap from sealing relation with the previously opened dispensing aperture.

SUMMARY OF THE INVENTION

This invention may be briefly described as an improved resealing cap construction for easy open end can closures that includes, in its broader aspects, the interposition of a hinge means of markedly decreased bending stiffness intermediate a readily displaceable sealing portion thereof and locus of securement of the cap assembly to the can end closure. In its narrower aspects, the subject invention includes the provision of a monolithic sealing cap assembly having bifurcated hinge means of markedly reduced bending stiffness disposed adjacent to the situs of riveted securement of the cap assembly to the can end closure.

Among the advantages of the subject invention is an enhanced security of attachment of a sealing cap assembly to a can end closure element and an attendant minimization of hazard in the event of blow off of the cap from sealing engagement with the container opening as may be occasioned by undue pressure buildup therein.

The primary object of this invention is the provision of an improved resealing cap assembly for easy open end can closures.

A further object of the invention is the provision of an improved cap assembly for resealable easy open can ends and particularly for a resealable easy open can end construction of the type disclosed in U.S. Pat. Nos. 4,580,692 and 4,648,528.

Other objects and advantages of the invention will become apparent from the following portions of this specification and from the appended drawings which illustrate, in accord with the mandate of the patent statutes, a presently preferred embodiment of a can end construction and resealable cap assembly that incorporates the principles of this invention.

DETAILED DESCRIPTION OF THE INVENTION

As pointed out above, the invention will be described in association with a resealable easy open end construction of the general type disclosed in U.S. Pat. No. 4,648,528, the disclosure of which is herein incorporated by reference. However, it should be understood that the invention may be used in other easy open end can constructions.

Where the words "upwardly", "inward", "outwardly", "under" and the like are used hereinafter, their meaning is to be taken with reference to a can in an upright position having a can end closure incorporating this invention attached to the top end thereof.

Figure 1:
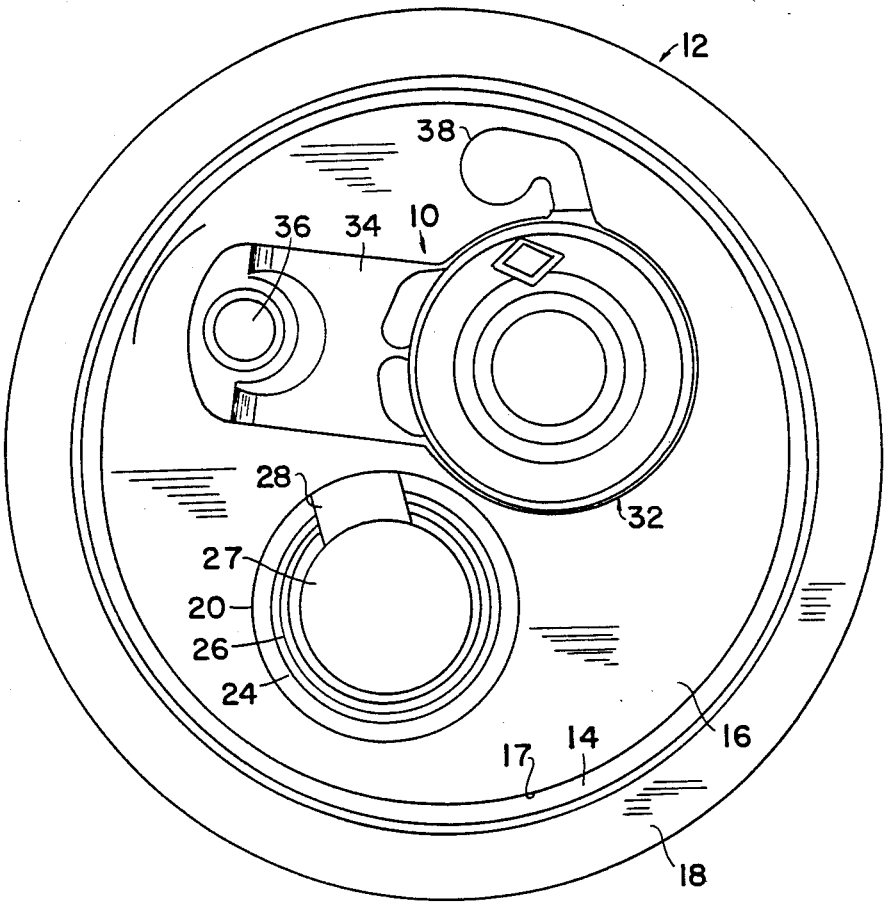
FIG. 1 is a plan view of a resealing cap construction incorporating the principles of this invention as included in a resealable easy open end can end construction of the general type disclosed in U.S. Pat. No. 4,580,692.

Referring to the drawings and initially to FIG. 1, a resealable cap assembly incorporating the principles of this invention is disclosed in association with a can end closure of the general type disclosed in said U.S. Pat.

No. 4,580,692. Such can end closure 12 includes a substantially flat or planar end wall portion 16, a countersink defining inner sidewall 17 and an outer sidewall 14 terminating in an upwardly and outwardly projecting annular flange 18 forming a chime for conventional attachment of the can end closure to a can body by double seaming.

As best shown in FIG. 1, the can end closure 12 further includes an upwardly projecting dispensing spout 20 preferably formed as an integral portion thereof. Such spout 20 includes an elevated and inclined top wall 24 having a score line 26 interrupted by a hinge 28 partially circumscribing and defining an opening panel 27 depressible inwardly of the can by fracture of the score line. Associated with the dispensing spout 20 is a resealing cap assembly generally designated 10, preferably molded in one piece using a plastic material having a low modulus of elasticity, such as, for example, low density polyethylene.

Figure 2:
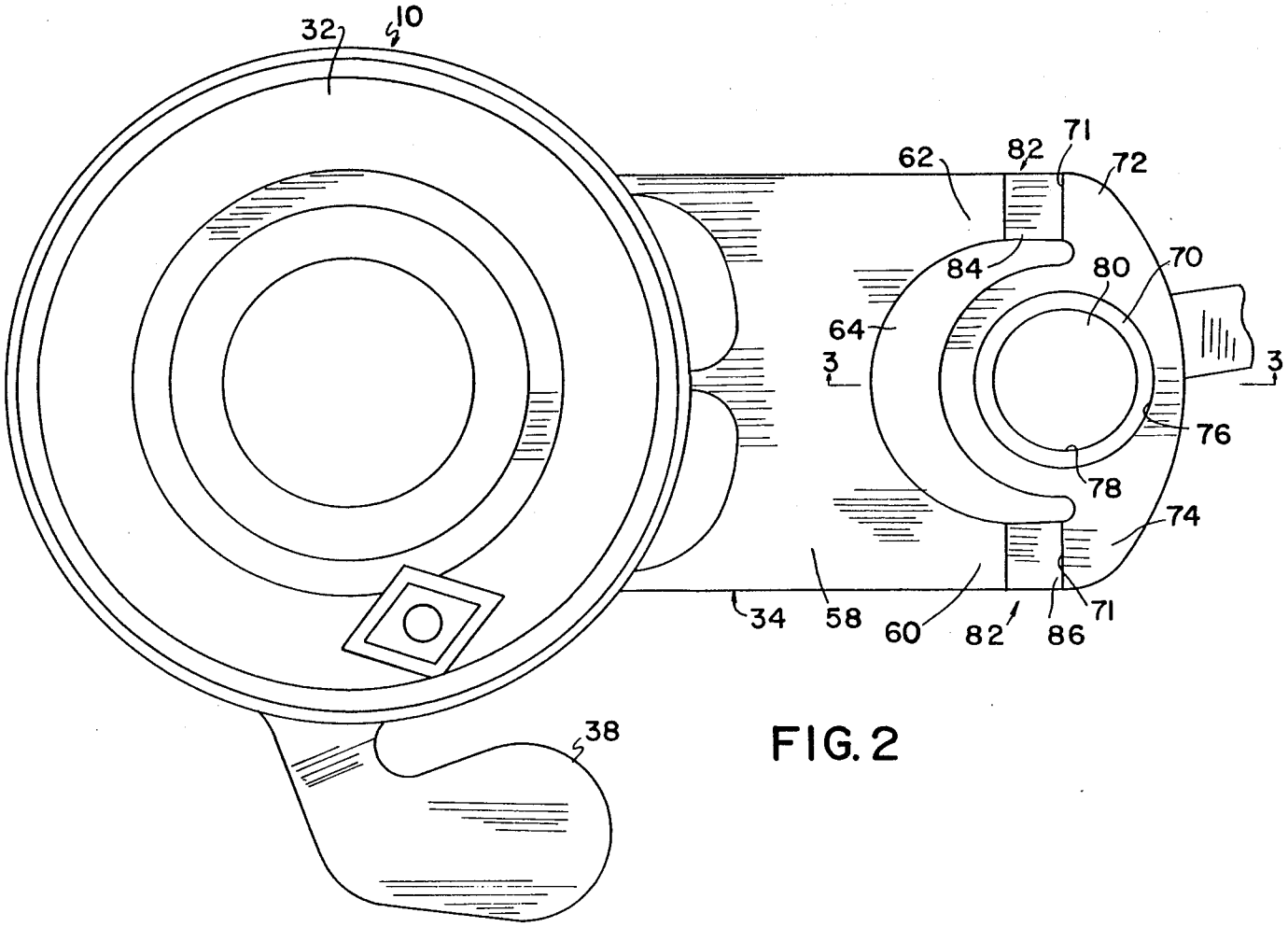
FIG. 2 is an enlarged plan view of the resealing cap shown in FIG. 1.
Figure 3:
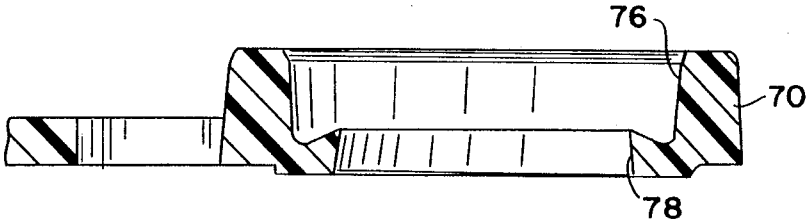
FIG. 3 is a further enlarged sectional view of a portion of the resealing cap as taken on the line 3—3 on FIG. 2.

As best shown in FIGS. 1–3, the resealing cap assembly 10 includes a sealing cap portion 32 adapted to be placed in sealing relation over the spout 20 and the score line defined opening panel 27 therein, an extending arm portion 34 connected at one end to the sealing cap portion 32 and a tab 38 projecting outwardly from the sealing cap portion 32 for convenience in manipulation of the cap assembly. The cap assembly 10 is pivotally attached to the end wall 16 by a rivet 36 extending through an opening in a boss 70 disposed at the second and remote end of the arm portion 34. The outboard edge of the flange portion of the rivet 36 is formed downwardly a controlled amount when the rivet is staked to attach the cap assembly 10 to the can end in such manner as to insure that there is secure engagement between the rivet 36 and lip 78 of the boss 70, yet still permit the sealing cap portion 32 to be rotated by hand about the rivet 36 with relative ease. Preferably, the rivet 36 is an integrally formed portion of the end wall 16 of the can closure 12.

Experience to date has indicated that the resealable cap construction disclosed in the aforesaid U.S. Pat. No. 4,580,692 may be subject to separation from the can end closure at the locus of rivet attachment when blow off of the sealing cap portion 32 from the spout 20 occurs as a result of excessive pressure buildup within a resealed container.

Figure 4:
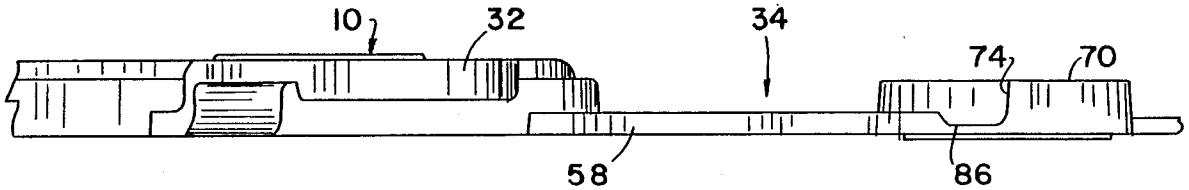
FIG. 4 is a side elevation of a portion of the cap shown in FIG. 2.

Referring now to FIGS. 2–4, in order to insure against separation of the resealable cap assembly 10 from the can end closure 12 and to thereby reduce potential hazard to a user, the extending arm portion 34 disposed intermediate the sealing cap 32 and the situs of riveted attachment to the can end closure is selectively contoured to markedly decrease the bending stiffness of arm 34 at the latter location. The main body 58 of the arm 34, as best shown in FIG. 4, is suitably of a first and uniform predetermined thickness sufficient to insure rotative displacement of the cap assembly as an entity when desired and to minimize, if not prevent, curling thereof in the direction perpendicular to the end closure. The end of the arm 34 adjacent rivet 36 is of bifurcated character defining a pair of spaced apart ends 60 and 62 separated by a crescent shaped opening 64.

Disposed intermediate the ends 60 and 62 is a circular boss 70 having a pair of extending wings 72, 74 disposed in aligned spaced relation with the bifurcated ends 60 and 62 of the main body portion 58 of the extending arm 34. The boss 70 and extending wings 72, 74 are of a second predetermined thickness of a magnitude substantially greater than that of the main body portion 58 of the extending arm 34 to markedly increase the bending stiffness thereof. As best shown in FIG. 3, the boss 70 contains an upper bore 76 sized to accommodate a flattened rivet head therewithin and a lower bore 78 sized to accommodate a rivet shank in such manner as to permit rotative displacement of the resealing cap assembly 10 relative to the container end closure 12. As illustrated in FIG. 2, the left edges 71 of the extending wings 72, 74 that are adjacent the hinge zone 82 are disposed in coaxial alignment with the diameter 80 of the boss 70.

Disposed intermediate the bifurcated ends 60 and 62 of the arm 34 and the left edges 71 of the wings 74 and 72 of the boss 70 is a hinge zone, generally designated 82, of markedly decreased bending stiffness. Such hinge zone is preferably constituted by a pair of integral links 84, 86 interconnecting the bifurcated ends 60 and 62 with the left edges 71 of wings 74 and 72 respectively, said hinge zone being of a third predetermined thickness of a magnitude less than said first predetermined thickness of the arm 34.

While the actual thickness of the main body portion 58, the wings 74 and 72 and the links 84 and 86 are determined by the nature and character of the material employed and methods of manufacturing the resealing cap assembly, a general indication of suitable dimensions and relative thicknesses for a presently preferred construction would be to have the main body portion 58 about 0.030 inch thick, the wings 72 and 74 about 0.075 inch thick and the links 84 and 86 about 0.015 inch thick.

Such reduced thickness links 84, 86 in association with the greater thickness of the extending arm 34 and boss wings 72, 74 function to selectively markedly decrease the bending stiffness of the resealable cap assembly at such hinge zone location and provide, in effect, a readily bendable hinge intermediate the end of arm 34 remote from the sealing cap portion 32 and the situs of securement of the cap assembly 10 to the container end closure 12. Such hinge zone 82 of reduced bending stiffness operates to minimize, if not effectively eliminate, the magnifying of the blow-off forces by leverage action and the concentration of the magnified forces to a small portion of the locus of rivet securement that characterize utilization of an arm 34 of uniform thickness, including the hinge zone, such as that incorporated in the structure disclosed in U.S. Pat. No. 4,580,692. In addition, the preferred bifurcation of the end of arm 34 and disposition of the left edges 71 of the wings 72 and 74 in alignment with a diametral extension of the boss 70 serves to divide the unmagnified separating forces created by cap blow off and to transmit half of these unmagnified forces to each of two points located at opposite ends of the same diameter. Cooperatively associated therewith, the increased thickness of the boss 70 serves to provide an increase in bending stiffness at such location and in a consequent generally uniform distribution of any force or load tending to separate the cap assembly from the rivet around the entire perimeter of engagement between the rivet and cap. Such described construction has not only effectively eliminated cap assembly separation from the container end closure in the event of sealing cap blow off but has further reduced the possibilities of accidental loss of the sealing cap prior to and during use thereof.

Having thus described my invention, I claim:

1. A cap assembly for substantially gas tight sealing engagement with a container closure having an opening therein circumscribed by a sealing surface thereon, the cap assembly comprising a seal portion releasably engageable in surrounding gas tight sealing relation with said sealing surface on said container closure circumscribing the opening therein, an extending arm portion connected at one end to said seal portion and having bifurcated second end disposed remote therefrom, a boss adjacent to the second end of said arm having an opening therethrough to accommodate a rivet for securement of the cap assembly to said container closure, and hinge means interconnecting said bifurcated second end of said extending arm to said boss to permit flexure of said seal portion and said arm portion relative to said boss and to minimize risk of separation of said boss from said rivet.

2. A cap assembly as set forth in claim 1 wherein said hinge means has a bending stiffness less than that of said arm portion and said boss.

3. A cap assembly as set forth in claim 1 wherein said seal portion, extending arm portion, hinge means, and boss are integrally interconnected to form a monolithic structure.

4. A cap assembly as set forth in claim 1 wherein one end of said hinge means is disposed on a diametric centerline extension of the opening in said boss, said diametric centerline being perpendicular to a centerline through the centers of said boss and said seal portion.

5. A cap assembly as set forth in claim 1 wherein said opening in said boss includes an upper bore sized to rotatably accommodate a flattened head of said rivet, and a lower bore of reduced diameter sized to rotatably accommodate a shank portion of said rivet.

6. A cap assembly for substantially gas tight sealing engagement with a container closure having an opening therein circumscribed by a sealing surface thereon, the cap assembly comprising a seal portion releasably engageable in surrounding gas tight sealing relation with said sealing surface on said container closure circumscribing the opening therein, an extending arm portion of a first predetermined thickness connected at one end to said seal portion and having a bifurcated second end disposed remote therefrom, a boss of a second predetermined thickness of a magnitude greater than said first predetermined thickness disposed adjacent to the second end of said arm having an opening therethrough to accommodate a rivet for securement of the cap assembly to said container closure, and hinge means interconnecting said bifurcated second end of said extending arm to said boss to permit rapid flexure of said seal portion and said arm portion relative to said boss and to prevent separation of said boss from said rivet.

7. A cap assembly as set forth in claim 6 wherein said hinge means is of decreased bending stiffness and of a third predetermined thickness of a magnitude less than that of said boss.

8. A cap assembly as set forth in claim 6 wherein said hinge means is of decreased bending stiffness and is of a third predetermined thickness of a magnitude less than said first predetermined thickness.

9. A cap assembly as set forth in claim 8 wherein one end of said hinge means is disposed on a diametric centerline extension of the opening in said boss, said diametric centerline being perpendicular to a centerline through the center of said boss and said seal portion.

10. A cap assembly as set forth in claim 6 wherein said seal portion, extending arm portion, and hinge means are integrally interconnected to form a monolithic structure.

11. A cap assembly for substantially gas tight sealing engagement with a container closure having an opening therein circumscribed by a portion of said container closure having a sealing surface thereon, the cap assembly comprising a seal portion releasably engageable in surrounding gas tight sealing relation with said portion of said container closure circumscribing the opening therein, a support arm of a first predetermined thickness integrally connected at one end to said seal portion and having a bifurcated second end disposed remote therefrom defining a pair of spaced apart terminal ends, a boss of a second predetermined thickness of a magnitude greater than that of said first predetermined thickness disposed intermediate the spaced apart terminal ends of said second end of said support arm and having an opening therethrough to accommodate a rivet for securement thereof to said container closure, and readily bendable hinge means of a decreased bending stiffness relative to said support arm and boss interconnecting the terminal ends of said bifurcated second end of said support arm to said boss to permit rapid flexure of said seal portion and said arm portion relative to said boss and to prevent separation of said boss from said rivet.

12. A cap assembly as set forth in claim 11 wherein said opening in said boss includes an upper bore sized to rotatably accommodate a flattened head of said rivet, and a lower bore of reduced diameter sized to rotatably accommodate a rivet shank portion of said rivet.

13. A cap assembly as set forth in claim 11 wherein said seal portion, support arm and hinge means are integrally interconnected for form a monolithic structure.

* * * * *